US007918769B2

(12) United States Patent
LaMarque

(10) Patent No.: US 7,918,769 B2
(45) Date of Patent: Apr. 5, 2011

(54) PLYOMETRIC TRAINING DEVICE AND METHOD

(76) Inventor: Matthew LaMarque, Sand City, CA (US)

( * ) Notice: Subject to any disclaimer, the term of this patent is extended or adjusted under 35 U.S.C. 154(b) by 0 days.

(21) Appl. No.: 11/879,690

(22) Filed: Jul. 18, 2007

(65) Prior Publication Data

US 2009/0023562 A1 Jan. 22, 2009

(51) Int. Cl.
*A63B 21/06* (2006.01)
*A63B 21/078* (2006.01)

(52) U.S. Cl. ..... 482/93; 482/104

(58) Field of Classification Search ..... 482/93–101, 482/104, 135–138, 142
See application file for complete search history.

(56) References Cited

U.S. PATENT DOCUMENTS 4,949,959 A * 8/1990 Stevens ..... 482/104
4,998,721 A * 3/1991 Anders et al. ..... 482/4
5,316,534 A 5/1994 Dalebout et al.
5,989,166 A * 11/1999 Capizzo et al. ..... 482/104
6,280,361 B1 * 8/2001 Harvey et al. ..... 482/8
6,287,243 B1 * 9/2001 Isom et al. ..... 482/142
6,338,701 B1 1/2002 Webber
6,893,381 B2 * 5/2005 Slawinski ..... 482/8
7,134,987 B2 11/2006 Goldstein
7,163,488 B2 * 1/2007 Anders et al. ..... 482/4
2005/0233871 A1 * 10/2005 Anders et al. ..... 482/93

* cited by examiner

*Primary Examiner* — Fenn C Mathew
(74) *Attorney, Agent, or Firm* — Patrick Reilly

(57) ABSTRACT

A method and device for use in plyometric muscular training is provided. In a first version, a rigid frame is provided having a trainee's position, a pair of cables and a weighted bar. The cables are positioned between the trainee's position and the bar. Each cable is attached at an upper location and a forward location of the frame. The cables partially constrain the movement of the bar and restrain the bar from striking sections of the trainee's body. The trainee may explosively push or throw the bar away from the trainee's position and towards the cable attachment locations, wherein the bar is released from the trainee's grasp. The return pathway of the bar is determined by the force of gravity, the force provided by the trainee and the constraints of the cables. The cables reduce the risk of injury to the trainee.

14 Claims, 6 Drawing Sheets

PLYOMETRIC TRAINING DEVICE AND METHOD

FIELD OF THE INVENTION

The present invention is related to plyometric muscle strengthening devices and methods. More particularly the present invention is related to methods and devices for safely applying plyometric techniques.

BACKGROUND OF THE INVENTION

Plyometric training techniques often require that a weighted bar be pushed away by a trainee from a starting position as quickly as possible by the trainee. It is sometimes desirable that the trainee push the bar beyond the trainee's grasp; the bar is then typically captured by the trainee in a gravity-directed return movement of the weighted bar toward the starting position. The trainee may thereby be placed in the pathway of the returning bar and can run a risk of injury by the returning bar.

Plyometric muscular training is used to increase absolute muscle strength in numerous physical training and therapeutic programs. In particular, the development of explosive strength affected by plyometric muscular training is important for most sports. This ability is difficult to increase with conventional peak-contraction training methods wherein the fully contracted muscle is maintained in continuous tension.

When a concentric contraction occurs immediately following an eccentric contraction, then the force generated can be dramatically increased. This increase in force is lost if the eccentric contraction is not followed immediately by a concentric effort. To express this greater force the muscle must contract within the shortest time possible. This whole process is frequently called the stretch shortening cycle and is the underlying mechanism of plyometric training. Plyometric training places increased stretch loads on the working muscles. As the muscles become more tolerant to the increased loads, the stretch-shortening cycle becomes more efficient.

A muscle develops its maximum force during a rapid eccentric contraction. An "eccentric contraction" occurs when a muscle is forced to lengthen due to the high external load, although it may be fully activated. "Contraction" in this context does not necessarily imply shortening. Contractions that permit the muscle to shorten are referred to as "concentric contractions." In concentric contractions, the force generated by the muscle is always less than the muscle's maximum. Of course, muscles seldom perform one type of contraction in isolation during athletic movements.

A bilateral deficit can also be addressed by plyometric muscular training techniques. The bilateral deficit is the difference between the maximal effort that can be developed with one arm (or leg) and two arms (or legs) working together. For example, persons generally cannot exert a force during a two-arm effort that is twice that of the one-arm maximal effort.

Plyometric training techniques can be used to increase physical fitness, enhance athletic skills, and improve mobility in a wide range of persons. There is, therefore, a long felt need to provide devices and methods that safely make the benefits of plyometric muscular training techniques to a wide range of people.

OBJECTS OF THE INVENTION

It is an object of the present invention to provide a method that enables the use of a weight in a plyometric muscular training protocol.

It is another object of the present invention to provide a device that enables the use of a weight bar in a plyometric muscular training protocol.

It is an object of certain preferred alternate embodiments of the Method of the Present Invention to provide a limitation to the range of motion of a weighted bar used in a plyometric muscular training protocol.

It is an object of certain other preferred alternate embodiments of the Method of the Present Invention to provide a cable that limits the range of motion of a weighted bar when used in a plyometric muscular training protocol.

SUMMARY OF THE INVENTION

These and other objects will be apparent in light of the prior art and this disclosure. In a first preferred embodiment of the Present Invention, or first version, a plyometric training device is provided. The first version may include a frame, an upper cable, a front cable, and a weight, where the frame presents an upper anchor feature for coupling with the upper cable and a front anchor feature for coupling with the front cable. The upper cable includes an upper frame end attached to the upper anchor feature and an upper weight end coupled with the weight. The front cable includes a front frame end attached to the front anchor feature and a front weight end attached to the weight. The weight may be propelled by a subject while the movement range of the weight is limited to a range of movement permitted by the length restrictions of the upper cable and the front cable. The upper cable may optionally be selectably attachable to enable selectable variation of the length of cable of the upper cable disposed between the upper anchor feature and the weight. The front cable may additionally, alternatively and/or optionally be selectably attachable to enable selectable variation of the length of cable of the front cable disposed between the front anchor feature and the weight.

In various variations of the first version the weight may be or comprise a bar, a bar with weights, a substantially spherical weight, a medicine ball, and/or other suitable weights(s) known in the art. The weight may also further include a first weight and a second weight where the first weight and the second weight may have substantively equivalent mass and are optionally separated by a length of bar.

The upper cable may be configured to limit the movement range of the weight to restrict the weight from falling below a torso of the subject when the subject is standing and insubstantial contact with a vertical support pad. The vertical pad is sized and shaped to at least partially support the subject's torso in a position that maintains the subject's torso is beyond the movement range of the weight allowed by the upper cable and the front cable.

The first version may further comprise a second upper cable and/or a second front cable, whereby the weight may be propelled by a subject and the weight is limited within a range of movement by the length restrictions of the upper cable, the second upper cable, the front cable, and/or the second front cable.

An alternate preferred embodiment of the Present Invention, or second version, a plyometric exercise device is provided within a physical structure. The physical structure may present a floor planar horizontal floor, an upper anchor feature and a front anchor feature. The second version may include one or more upper cables, one or more front cables, and a weight. At least one upper cable of the second version is coupled with the physical structure and limits the weight from striking the floor. In addition, at least one front cable is attached to the physical structure and the weight may be propelled by a subject within a range of movement of the weight limited by the length restrictions of the upper cable(s) and the front cable(s).

The Method of the Present Invention may further provide a method of enabling plyometric muscular training wherein a plyometric training device is provided. A subject is directed to grasp and propel the weight; and the subject is directed to catch the weight as the weight returns towards the subject after the weight is propelled by the subject.

The foregoing and other objects, features and advantages will be apparent from the following description of the preferred embodiment of the invention as illustrated in the accompanying drawings.

BRIEF DESCRIPTION OF THE DRAWINGS

These, and further features of the invention, may be better understood with reference to the accompanying specification and drawings depicting the preferred embodiment, in which: These, and further features of the invention, may be better understood with reference to the accompanying specification and drawings depicting the preferred embodiment, in which.

DETAILED DESCRIPTION OF A PREFERRED EMBODIMENT

In describing the preferred embodiments, certain terminology will be utilized for the sake of clarity. Such terminology is intended to encompass the recited embodiment, as well as all technical equivalents, which operate in a similar manner for a similar purpose to achieve a similar result.

Figure 1:
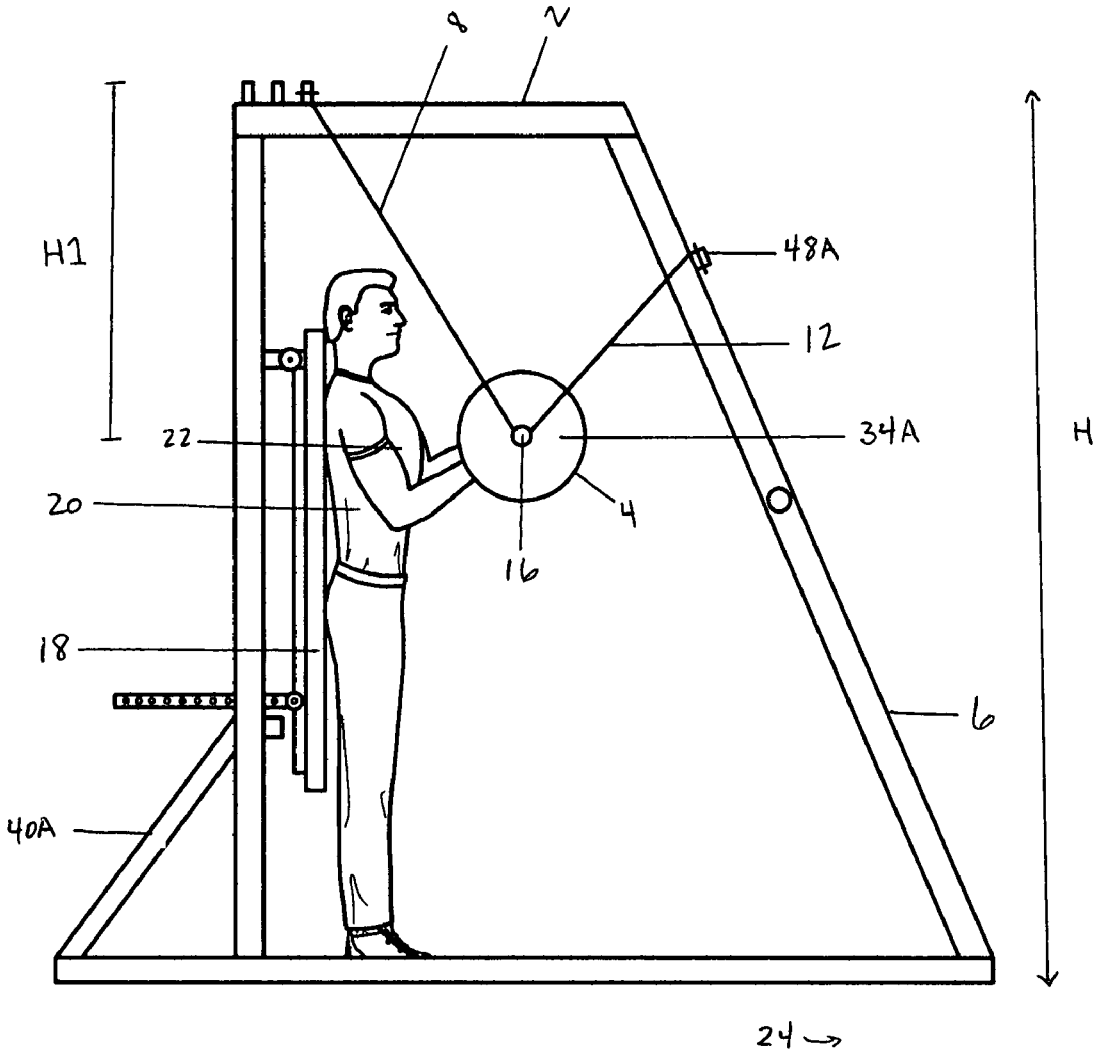
FIG. 1 is a perspective view of a first preferred embodiment of the present invention, or first version.

Referring now generally to the Figures, and particularly to FIG. 1, FIG. 1 shows a first preferred embodiment of the present invention 2, or first version 2, wherein a weight 4 is coupled to a frame 6 by means of a pair of upper cables 8 & 10 and a pair of front cables 12 & 14. The range of movement of the weight 4 is restricted by the frame 6 and each of the pair of upper cables 8 & 10 and the pair of front cables 12 & 14.

The weight 4, including a weighted bar 16, a first weight 4A and a second weight 4B, may conform to a published equipment standard for weight lifting competition, such as a standard published by the International Olympic Committee.

An optional vertical pad 18 may be attached to the steel frame 6 and configured to protect and support a subject's torso 22 when the subject 20 is manipulating the weighted bar 16.

The pair of upper cables 8 & 10 restrain the weight 4 from falling below a set parameter H1 along a height H axis from a floor 24. The set parameter height H1 may be adjustable by means of (a.) altering the location of attachment of one or more cables 8, 10, 12 & 14 to the frame 6, and/or (b.) altering the length of cabling disposed between one or more cables 8, 10, 12 & 14 disposed between the frame 6 and weight 4.

Figure 2:
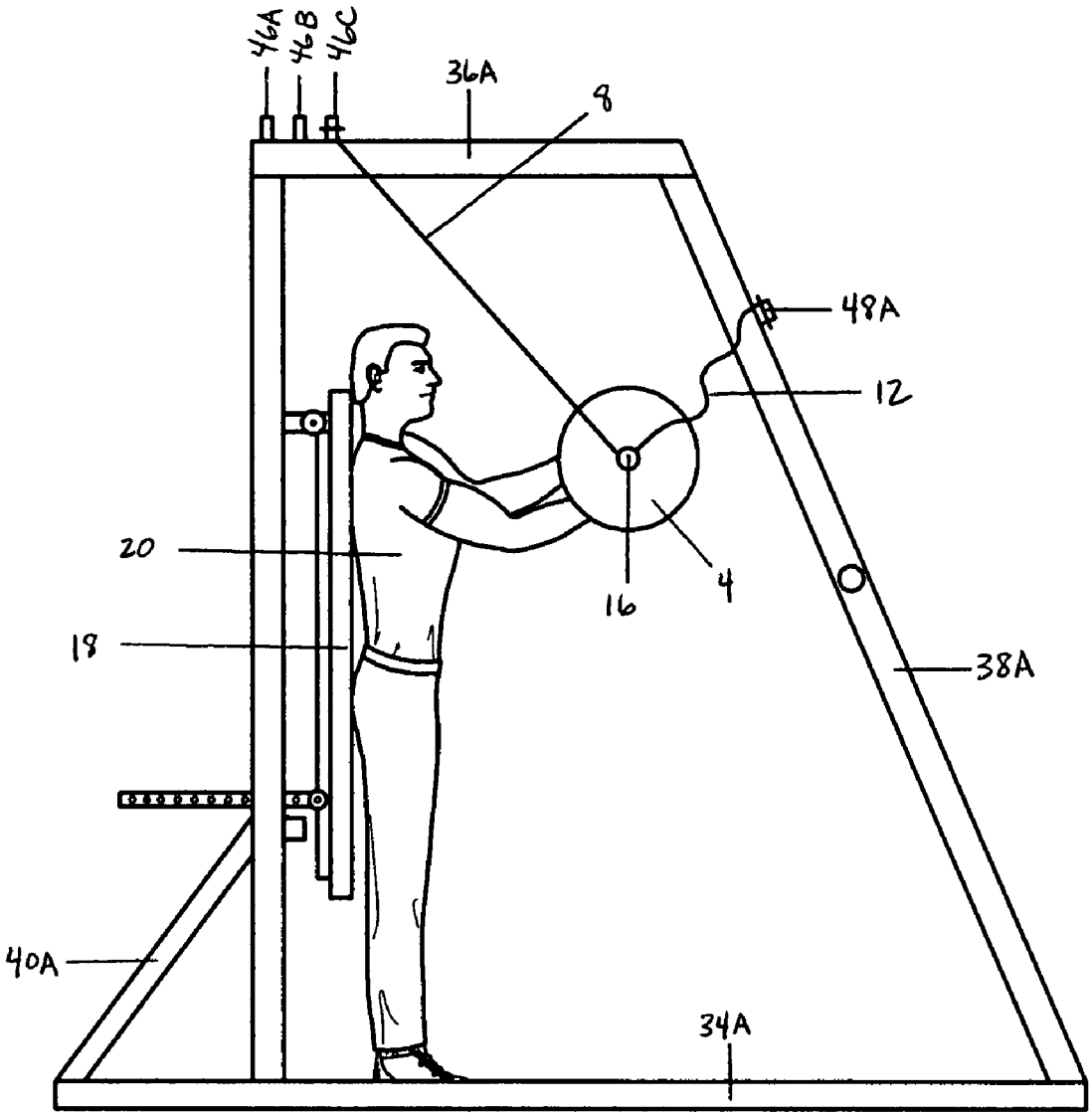
FIG. 2 illustrates the first version of FIG. 1 employed by a subject in a plyometric use.

Referring generally to the Figures and particularly to FIG. 2, FIG. 2 shows one mode of operation of the first version 2. The subject 20 may grasp the weighted bar 16 while standing between the vertical pad 18 and the weighted bar 16, wherefrom the subject 20 may throw the weighted bar 16 towards a front F of the first version 2. The weighted bar 16 will therefrom travel away from the subject 20 and then fall back towards the subject 20 in a pathway substantially determined by (1.) the original force provided by the subject 20, (2.) the force of gravity, (3.) the constraints of the pair of upper cables 8 & 10, and (4.) the constraints of the pair of front cables 12 & 14. Upon return of the weighted bar 16 towards the subject 20, the subject 20 may then grasp the weighted bar 16 and manually apply force to redirect the weighted bar 16 again away from the subject 20 and towards the front F of the first version 2. The subject 20 may repeat the throwing and catching of the weighted bar 16 to execute a plyometric weight training protocol. It is understood that other forces may affect the movement of the weight 4, such as the inertial state of the weight 4 when first grasped by the subject 20, air resistance, air pressure, magnetic forces, and other forces known in the art.

In one mode of operation of the first version 2, the subject 20 may grasp the weighted bar 6 while standing between the pad 18 and the weighted bar 16, wherefrom the subject 20 may throw the weighted bar 16 towards the front of the steel frame 6. The weighted bar 16 will therefrom travel away from the subject 20 and then fall back towards the subject 20 in a pathway determined by (1.) the original force provided by the subject 20, (2.) the force of gravity, and (3.) the constraints of the upper cables 8 & 10 and the front cables 12 & 14. Upon return of the weighted bar 16 towards the subject 20, the subject 20 may then grasp the weighted bar 16 and manually apply force to redirect the weighted bar 16 again away from the subject 20 and towards the front of the steel frame 6. The subject 20 may repeat the throwing and catching of the weighted bar 16 to execute a plyometric weight training protocol.

Figure 3:
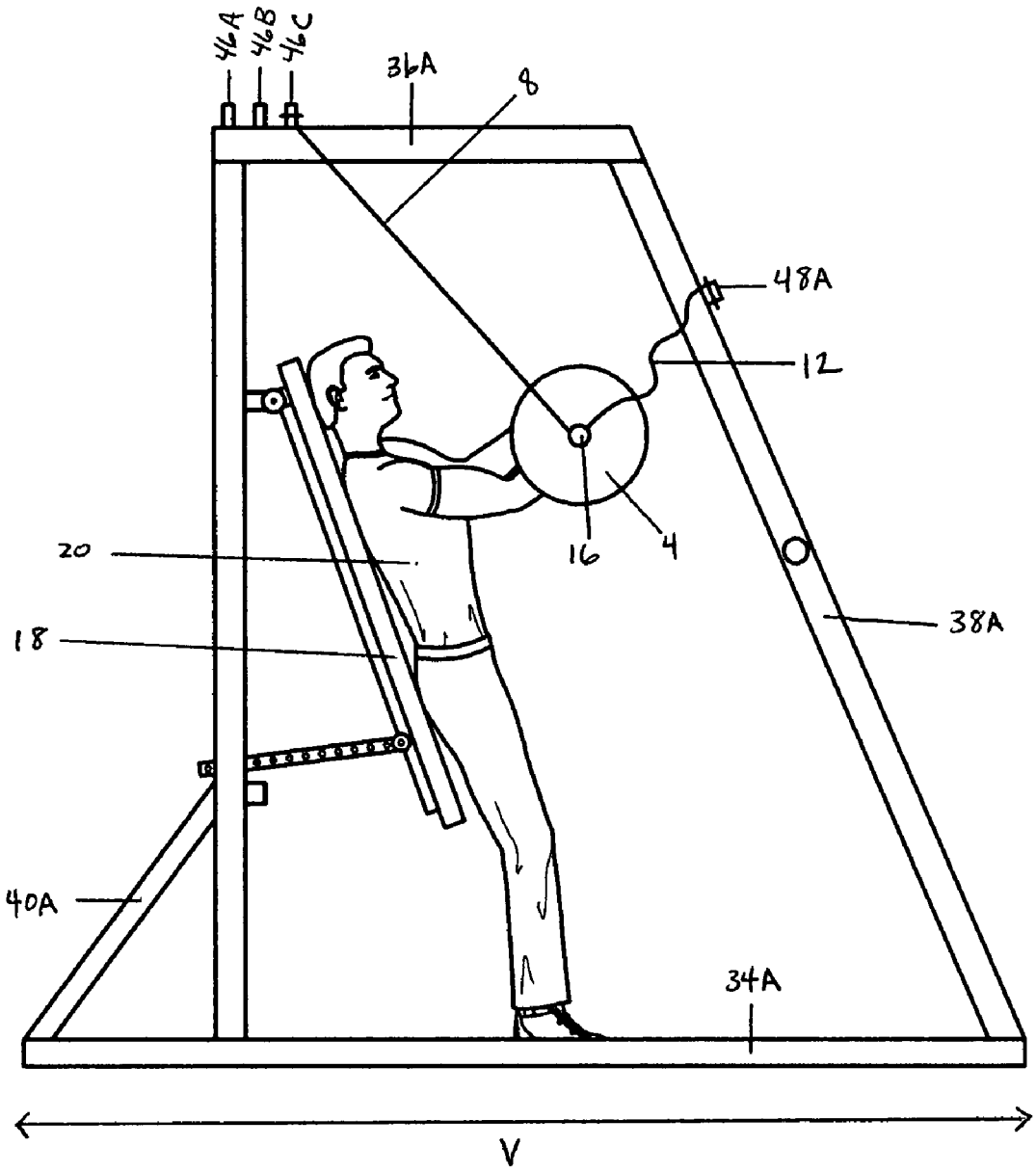
FIG. 3 illustrates the first version of FIG. 1 having a vertical pad at an angle employed by a subject in a plyometric use.

Referring generally to the Figures and particularly to FIG. 3, FIG. 3 shows the first version 2 in an alternate configuration, wherein the vertical pad bench rest may be adjusted so that the bottom of the vertical pad 18 may be adjusted forward towards the front F of the frame 6. The subject 20 may lean upon the adjusted vertical pad 18 to protect and stabilize the subject's torso 22. The vertical pad may be adjustable along the vertical axis V to a bench angle of 45 degrees.

Figure 4:
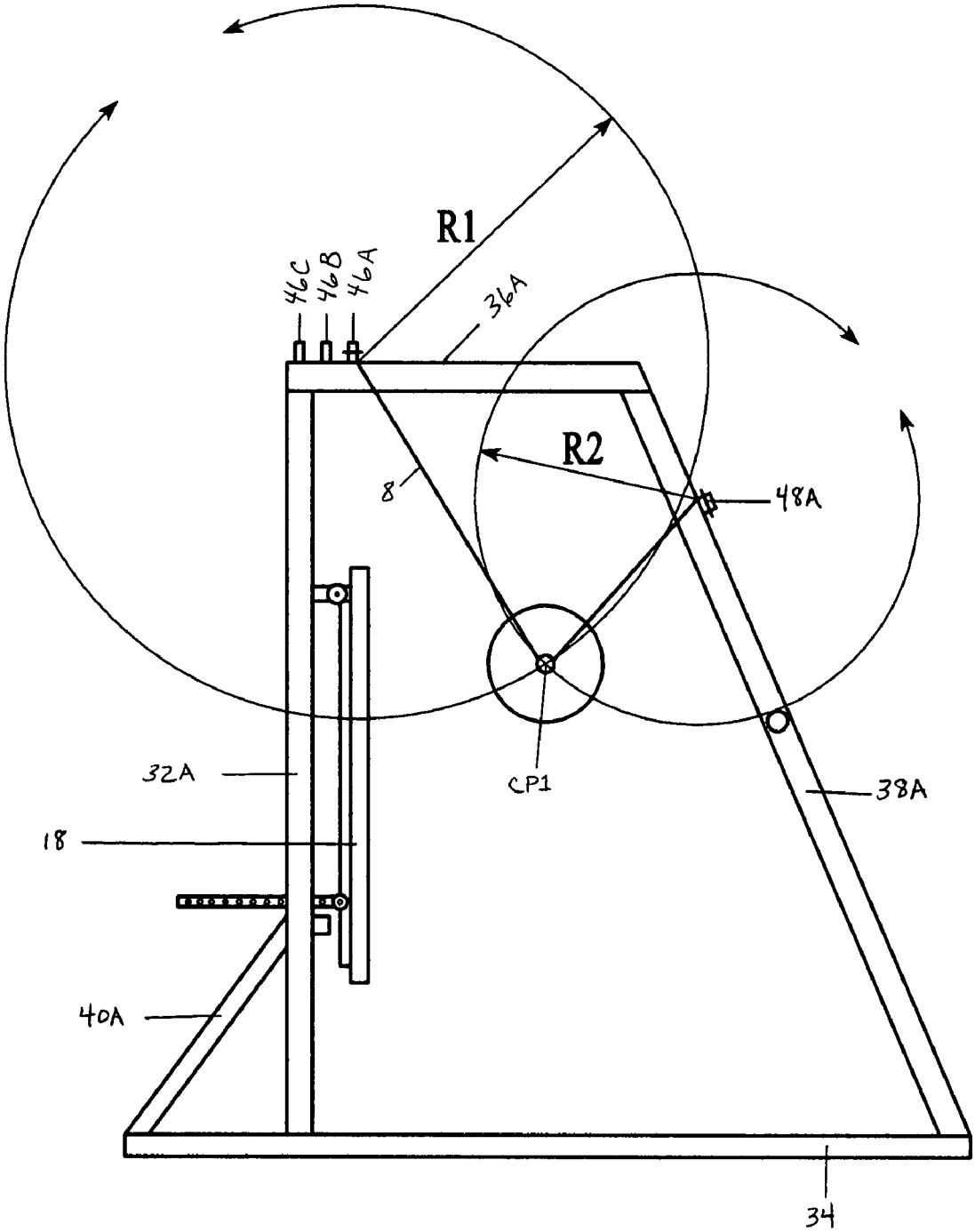
FIG. 4 is a detailed view of the first version of FIG. 1.
Figure 5:
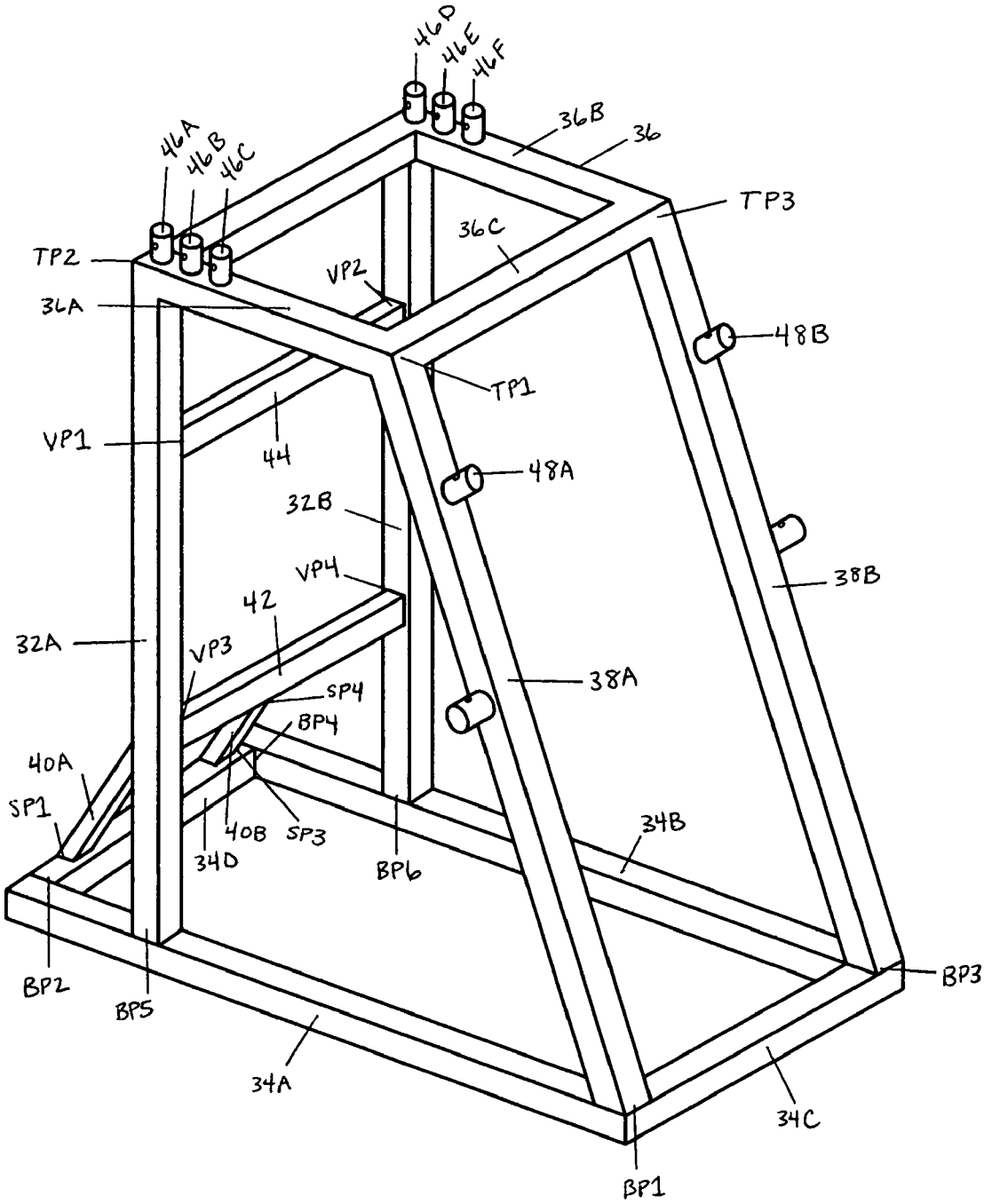
FIG. 5 is a perspective view of the frame of FIG. 1.

Referring now to the Figures and particularly to FIGS. 4 & 5, FIG. 4 is a detailed illustration of the first version 2. It is understood that the numerical dimensions included in the Figures are denoted in inches, wherein a pair of vertical members 32A & 32 B of the frame 6 extend approximately 83 inches upward from, i.e. normal from, a geometric plane PB of a base frame 34.

Referring now generally to the Figures, and particularly to FIGS. 4 and 5, FIG. 5 is an isometric view of the frame 4 showing the base frame 34, a topframe 36, the two vertical members 32A & 32B, two front members 38A & 38B, a pair of strut supports 40A & 40B, a lower rear member 42, an upper rear member 44, pluralities of upper cable posts 46A-46F and a pair of front cable anchors 48A & 48B.

Referring now generally to the Figures and particularly to FIG. 5, FIG. 5 presents the base frame 34 as including a first base side member 34A and a second base side member 34B that are each approximately 96 inches in length and are positioned substantively in parallel within the base frame 34. The first base side member 34A is attached to both a base front member 34C at a first base point BP1 and to a base rear member 34D at a second base point BP2. The second base side member 34B is attached to both the base front member 34C at a third base point BP3 and to the base rear member 34D at a fourth base point BP4. The elements 34A, 34B, 34C &

34D of the base frame 34 are made of steel box tubing walls of 0.0120 inch thickness 2 inch by 3 inch cross-section. The base front member 34C and the base rear member 34D are each approximately 50 inches in length and are positioned substantially in parallel within the base frame 34. All four base members 34A, 34B, 34C & 34D are each intersected by a geometric base plane PB and are configured to simultaneously physically contact and rest upon the substantively planar weight bearing floor 24.

In further reference to the structure of the frame 6, the first and second front members 38A & 38B are further configured to extend at a 65 degree angle from the plane PB and towards a geometric plane PT of the topframe 36. It is understood that the topframe 36 is intersected by the geometric plane PT, and that the plane PT is substantially parallel to the plane PB. In particular, the first front member 38A and the second front member 38B are each separately attached to both the base frame 34 and the topframe 36, and extend from the plane PB towards the plane PT at an angle of 65 degrees relative to the plane PB. More particularly, the first front member 38A extends from the first attachment point BP1 of the base frame 34 to a first top attachment point TP1 of the topframe 36, and the second front member 38B extends from the third base attachment point BP3 of the base frame 34 to a third top attachment point TP3 of the topframe 36.

The first vertical member 32A extends substantively vertically from a fifth base attachment point BP5 of the base frame 34, i.e., along a direction normal from the plane PB, to a second top attachment point TP2 of the topframe 36. The fifth base attachment point BP5 is located approximately 18 inches from the second base attachment point BP2 and 78 inches from the first base attachment point BP1. The first vertical member 32A is approximately 83 inches in length and is made of steel box tubing walls of 0.0120 inch thickness 2 inch by 3 inch cross-section.

The second front member 38B extends substantively in parallel with the first front member 38A and from the third attachment point BP3 of the base frame 34 at an angle of 65 degrees from the plane PB, to the third top attachment point TP3 of the topframe 36.

The second vertical member 32B extends substantively parallel with the first vertical member 32A and vertically from a sixth base attachment point BP6 of the base frame 34, i.e., normal from the plane PB, to a fourth top attachment point TP4 of the topframe 36. The sixth base attachment point BP6 is located approximately 18 inches from the fourth base attachment point BP4 and 78 inches from the third base attachment point BP3. The second vertical member 32B is approximately 83 inches in length and is made of steel box tubing walls of 0.0120 inch thickness 2 inch by 3 inch cross-section.

The topframe 36 includes a first top side member 36A and a second top side member 36B that are positioned substantively in parallel. The first top side member 36A is attached to both (1.) a top front member 36C at the first top attachment point TP1; and (2.) a top rear member 36D at the second top attachment point TP2. The second top side member 36B is attached to both the top front member 34C at a third top attachment point TP3 and to the top rear member 36D at a fourth top point TP4. The elements 36A, 36B, 36C & 36D of the topframe 36 are made of steel box tubing walls of 0.0120 inch thickness 2 inch by three inch cross-section. The top side members 36A & 36B are approximately 41 inches in length and the top front member 36C and the top rear member 36D are each approximately 50 inches in length. All four top members 36A, 36B, 36C & 36D are each intersected by the geometric plane PT and are configured in combination with the base frame 34, the vertical members 32A & 32B, the two front members 38A & 38B, the pair of strut supports 40A & 40B, the lower rear member 42, and the upper rear member 44, to bear the weight of the weighted bar 16, the cables 8 & 10.

A first plurality of posts 46A, 46B & 46C of the first top side member 36A extends vertically two inches upwards and distally away from the planes PB and PT to provide attachment points for the first upper cable 8. Each of the first plurality of posts 46A, 46B & 46C are made of round steel stock approximately one inch in diameter and two inches in height.

A second plurality of posts 46D, 46E & 46F of the second top side member 36B extends vertically two inches upwards and distally away from the planes PB and PT to provide attachment points for the second upper cable 10. Each of the first plurality of posts 46D, 46E & 46F are made of round steel stock approximately one inch in diameter and two inches in height.

The pair of strut supports 40A & 40B, the lower rear member 42 and the upper rear member 44 are provided to increase the structural integrity of the frame 6. The upper rear member 44 is approximately 48 inches in length and is made of steel box tubing walls of 0.0120 inch thickness 2 inch by 3 inch cross-section. The upper rear member 44 is attached to (1.) the first vertical member 32A at a first vertical attachment point VP1 located approximately 60 inches above the plane PB of the base flame 34; and (2.) the second vertical member 32B at a second vertical attachment point VP2 located approximately 60 inches above the plane PB of the base frame 34.

The lower rear member 42 is approximately 48 inches in length and is made of steel box tubing walls of 0.0120 inch thickness 2 inch by 3 inch cross-section. The lower rear member 42 is attached to (1.) the first vertical member 32A at a third vertical attachment point VP3 located approximately 24 inches above the plane PB of the base frame 34; and (2.) the second vertical member 32B at a fourth vertical attachment point VP4 located approximately 24 inches above the base plane PB.

The first strut 40A is made of steel box tubing walls of 0.0120 inch thickness 2 inch by 3 inch cross-section, and is configured to extend at an angle of approximately 53 degrees from the plane PB from a first strut attachment point SP1 of the base rear member 34D to a second strut attachment point SP2 of the lower rear member 42. The first strut attachment point SP1 is located approximately on the base rear member 34D and 9 inches from the second base attachment point BP2 and 40 inches from the fourth base attachment point BP4. The second strut attachment point SP2 is located along the lower rear member approximately 9 inches from the third vertical attachment point VP3 and 40 inches from the fourth vertical attachment point VP4.

The second strut 40B is made of steel box tubing walls of 0.0120 inch thickness 2 inch by 3 inch cross-section, and is configured to extend at an angle of approximately 53 degrees from the plane PB from a third strut attachment point SP3 of the base rear member 34D to a fourth strut attachment point SP4 of the lower rear member 42. The third strut attachment point SP1 is located approximately on the base rear member 34D and 9 inches from the fourth base attachment point BP4 and 40 inches from the second base attachment point BP2. The fourth strut attachment point SP4 is located along the lower rear member approximately 9 inches from the fourth vertical attachment point VP4 and 40 inches from the third vertical attachment point VP3.

Referring now to the Figures and particularly to FIG. 4, FIG. 4 is a detailed view of the first upper cable 8 attached to both (1.) a first cable attachment point CP1 of the weight 4 and (2.) adjustably attached to a first post 46A of the first plurality of posts 46A, 46B & 46C. A first plurality of posts 46A, 46B & 46C are located in series and evenly spaced approximately three inches apart along the length of the first top side member 36A. Extending vertically two inches upwards and distally away from the planes PB and PT to provide attachment points for the first upper cable 8, each of the first plurality of points 46A, 46B & 46C are configured to accept and detachably constrain a loop 8A of the first upper cable 8, whereby the weight load of the weighted bar 16 may be at least partially transferred from weighted bar 16 to the first upper cable 8, and by means of the mechanical coupling of the first upper cable 8 to the first post 46A and the first cable attachment point CP1 to the steel frame 6. The first upper cable 8 and the second upper cable 10 are made of cable, chain or other suitable material known in the art and configured to support up to 500 kilograms of weight and moving at up to 100 meters per second.

The second plurality of posts 46D, 46E & 46F of the second top side member 36B are configured to support the weight of the weighted bar 16 as transferred via the second cable 10. The weighted bar 16 may conform to, and the first version 2 may be configured to employ the weighted bar 16, and other equipment conforming to one or more published standards of weight training and competition equipment, to include dimensions specified by national and international sports authorities, such as the International Olympic Committee.

Figure 6:
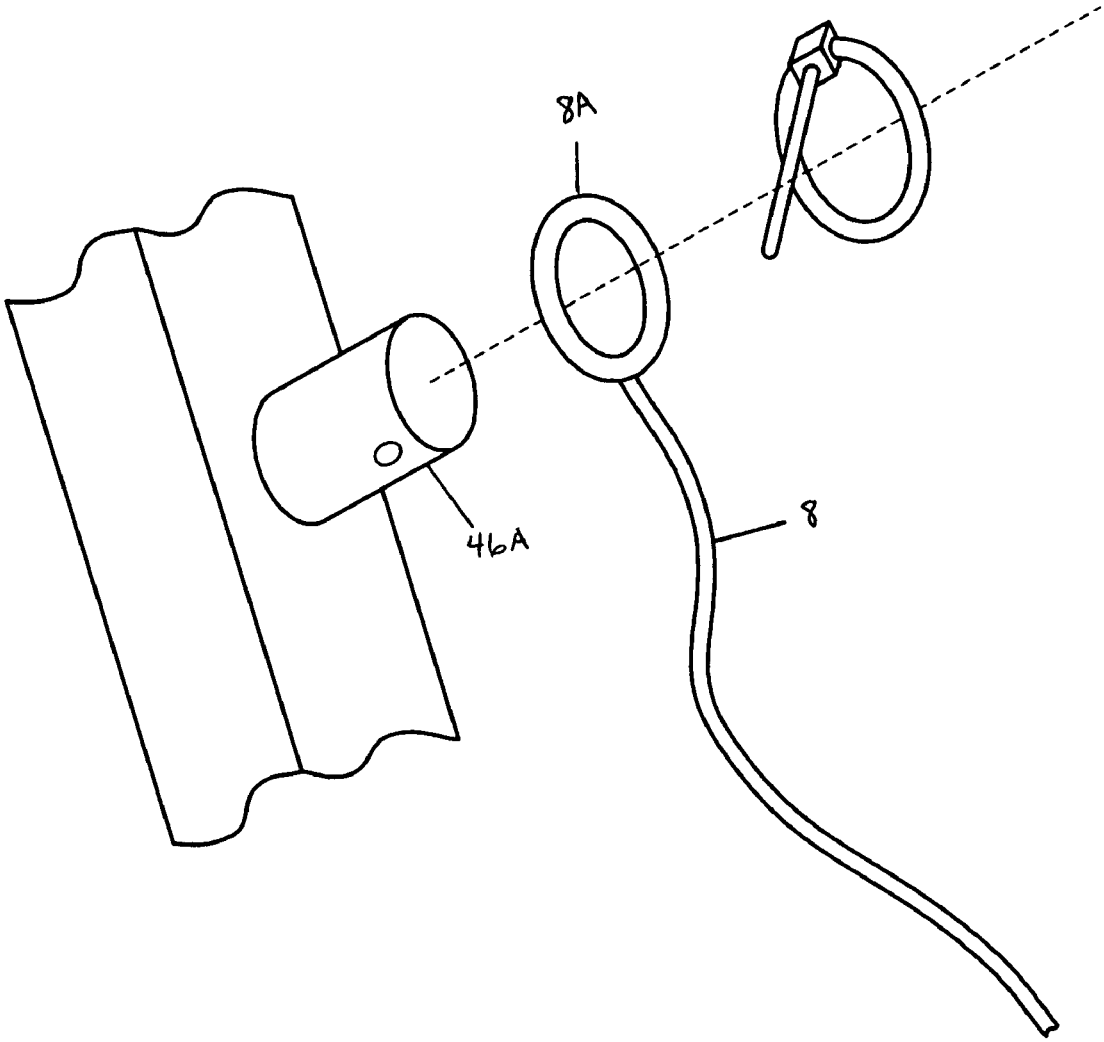
FIG. 6 is a detailed view of the loop of the first upper cable detached from a first post.

Referring now generally to the Figures, and particularly to FIG. 6, FIG. 6 shows the loop 8A of the first upper cable 8 detached from a first post 46A of the first plurality of posts 46A, 46B & 46C. A first plurality of posts 46A, 46B & 46C are located in series and evenly spaced approximately three inches apart along the length of the first top side member 36A. Extending vertically two inches upwards and distally away from the planes PB and PT to provide attachment points for the first upper cable 8, each of the first plurality of points 46A, 46B & 46C are configured to accept and detachably constrain a loop 8A of the first upper cable 8, whereby the weight load of the weighted bar 16 may be at least partially transferred from weighted bar 16 to the first upper cable 8, and by means of the mechanical coupling of the first upper cable 8 to the first post 46A and the first cable attachment point CP1 to the steel frame 6. The first upper cable 8 and the second upper cable 10 are made of cable, chain or other suitable material known in the art and configured to support up to 500 kilograms of weight and moving at up to 100 meters per second.

Those skilled in the art will appreciate that various adaptations and modifications of the just-described preferred embodiments can be configured without departing from the scope and spirit of the invention. Other suitable fabrication, manufacturing, assembly, and test techniques and methods known in the art can be applied in numerous specific modalities by one skilled in the art and in light of the description of the present invention described herein. Therefore, it is to be understood that the invention may be practiced other than as specifically described herein. The above description is intended to be illustrative, and not restrictive. Many other embodiments will be apparent to those of skill in the art upon reviewing the above description. The scope of the invention should, therefore, be determined with reference to the knowledge of one skilled in the art and in light of the disclosures presented above.

I claim:

1. A plyometric exercise device, the device comprising:

a. a frame, at least one upper cable of fixed length, at least one front cable of fixed length, and a weight, the frame having an upper anchor feature coupling with the upper cable in a position substantially above a user and a front anchor feature coupling with the front cable in a position substantially in front of a user;

b. the upper cable having an upper frame end attached to the upper anchor feature and an upper weight end coupled with the weight; and c. the front cable, positioned at an intersecting angle to the upper cable, having a front frame end attached to the front anchor feature and a front weight end attached to the weight, whereby the weight may be propelled by a subject and the weight is limited within a range of movement by the length restrictions of the upper cable and the front cable.

2. The device of claim 1, wherein the upper cable is configured to limit the movement range of the weight to restrict the weight from falling below a torso of the subject when the subject is standing.

3. The device of claim 1, wherein the weight comprises a bar.

4. The device of claim 3, wherein the weight further comprises a first weight and a second weight, the first weight and the second weight having substantively equivalent mass, and the first weight located proximate to a first end of the bar and the second weight located proximate to a second end of the bar.

5. The device of claim 4, wherein the first weight and the second weight are separated by a length of the bar.

6. The device of claim 5, further comprising a second upper cable, the second upper frame end attached to a second upper anchor feature of the frame and a second upper weight end coupled with the weight, whereby the weight may be propelled by a subject and the weight is limited within a range of movement by the length restrictions of the upper cable, the second upper cable, and the front cable.

7. The device of claim 3, further comprising a second front cable having a second front frame end attached to a second front anchor feature of the frame and a second front weight end attached to the weight, whereby the weight may be propelled by a subject and the weight is limited within a range of movement by the length restrictions of the upper cable, the front cable, and the second front cable.

8. The device of claim 7, further comprising a second upper cable, the second upper frame end attached to a second upper anchor feature of the frame and a second upper weight end coupled with the weight, whereby the weight may be propelled by a subject and the weight is limited within a range of movement by the length restrictions of the upper cable, the second upper cable, the front cable, and the second upper cable.

9. A method of enabling plyometric muscular training, the method comprising:

a. providing the device of claim 1;

b. directing the subject to grasp and propel the weight; and c. directing the subject to catch the weight as the weight returns towards the subject after the weight is propelled by the subject.

10. Within a physical structure having a floor planar horizontal floor, an upper anchor feature and a front anchor feature, a plyometric exercise device, the device comprising:

a. an upper cable, a front cable, and a weight;

b. the upper cable, of fixed length, having an upper frame end attached to the upper anchor feature at a position substantially above a user and an upper weight end coupled with the weight; and c. the front cable, of fixed length, positioned at an intersecting angle to the upper cable, and having a front frame end attached to the front anchor feature at a position substantially in front of the user, and a front weight end attached to the weight, whereby the weight may be propelled by the user and the range of movement of the weight is limited by the length restrictions of the upper cable and the front cable.

11. The device of claim 10, wherein the upper cable is configured to limit the movement range of the weight to restrict the weight from falling below a two foot height above the floor.

12. The device of claim 11, wherein the movement range of the upper cable is adjustable to selectively adjust the upper cable to restrict the weight from approaching the floor closer than a distance selected from within the range of two feet to four feet.

13. The device of claim 10, further comprising a second upper cable, the second upper frame end attached to a second upper anchor feature of the structure and a second upper weight end coupled with the weight, whereby the weight may be propelled by a subject and the weight is limited within a range of movement by the length restrictions of the upper cable, the second upper cable, and the front cable.

14. The device of claim 10, further comprising a second front cable having a second front frame end attached to a second front anchor feature of the structure and a second front weight end attached to the weight, whereby the weight may be propelled by a subject and the weight is limited within a range of movement by the length restrictions of the upper cable, the front cable, and the second front cable.

* * * * *